US009512777B2

(12) United States Patent
Bucksey

(10) Patent No.: US 9,512,777 B2
(45) Date of Patent: Dec. 6, 2016

(54) INTERNAL COMBUSTION ENGINES

(75) Inventor: Christian Bucksey, London (GB)

(73) Assignee: COX POWERTRAIN LTD., London (GB)

( * ) Notice: Subject to any disclaimer, the term of this patent is extended or adjusted under 35 U.S.C. 154(b) by 0 days.

(21) Appl. No.: 14/119,831

(22) PCT Filed: May 24, 2012

(86) PCT No.: PCT/GB2012/051161

§ 371 (c)(1),
(2), (4) Date: Jan. 30, 2014

(87) PCT Pub. No.: WO2012/160376

PCT Pub. Date: Nov. 29, 2012

(65) Prior Publication Data

US 2014/0165967 A1 Jun. 19, 2014

(30) Foreign Application Priority Data

May 24, 2011 (GB) ..... 1108766.5

(51) Int. Cl.

| | |
|---|---|
| ***F02B 25/08*** | (2006.01) |
| ***F02B 71/00*** | (2006.01) |
| ***F02B 75/28*** | (2006.01) |
| ***F01B 7/02*** | (2006.01) |
| ***F01B 7/08*** | (2006.01) |

(52) U.S. Cl.

CPC ..... *F02B 71/00* (2013.01); *F01B 7/02* (2013.01); *F01B 7/08* (2013.01); *F02B 75/28* (2013.01); *F02B 75/282* (2013.01)

(58) Field of Classification Search

CPC ..... F02B 75/28; F02B 71/00; F02B 2275/14; F01B 7/02; F01B 7/08; F01B 9/023; F01B 9/026; F02F 1/186; F02M 61/14

USPC ..... 123/51 BC, 55.2, 188.5, 53.3

See application file for complete search history.

(56) References Cited

U.S. PATENT DOCUMENTS

| | | | | |
|---|---|---|---|---|
| 1,984,288 | A | 12/1934 | Saunders | |
| 2,065,046 | A | 12/1936 | Bronander | |
| 4,305,349 | A * | 12/1981 | Zimmerly | 123/51 BB |
| 4,494,500 | A * | 1/1985 | Hansen | 123/190.17 |
| 5,083,530 | A * | 1/1992 | Rassey | 123/51 R |
| 5,331,926 | A * | 7/1994 | Vaux | F01B 9/023 123/196 R |
| 6,170,443 | B1 * | 1/2001 | Hofbauer | F02B 25/08 123/51 B |

(Continued)

FOREIGN PATENT DOCUMENTS

| | | |
|---|---|---|
| CN | 101529065 A | 9/2009 |
| GB | 446 070 A | 4/1936 |

(Continued)

*Primary Examiner* — John Kwon
*Assistant Examiner* — Tea Holbrook
(74) *Attorney, Agent, or Firm* — Seed IP Law Group LLP

(57) ABSTRACT

An internal combustion engine comprising at least one cylinder and a pair of opposed, reciprocating pistons within the cylinder forming a combustion chamber therebetween. The engine has at least one fuel injector disposed at least partly within the cylinder, the fuel injector having a nozzle that is positioned within the combustion chamber and through which the fuel is expelled into the combustion chamber, wherein the nozzle is exposed directly within the combustion chamber.

12 Claims, 10 Drawing Sheets

(56) References Cited

U.S. PATENT DOCUMENTS

| | | | | |
|---|---|---|---|---|
| 6,953,010 | B1 * | 10/2005 | Hofbauer | 123/46 R |
| 7,650,873 | B2 * | 1/2010 | Hofbauer et al. | 123/297 |
| 8,783,218 | B2 * | 7/2014 | Shen et al. | 123/51 R |
| 2003/0094164 | A1 * | 5/2003 | Lowi et al. | 123/543 |
| 2007/0283909 | A1 | 12/2007 | Hofbauer | |
| 2008/0302343 | A1 | 12/2008 | Carlson et al. | |
| 2010/0192923 | A1 * | 8/2010 | Cox | F01B 1/08 123/51 BC |
| 2011/0011375 | A1 * | 1/2011 | Carlson | F01B 3/0005 123/559.1 |
| 2014/0196693 | A1 * | 7/2014 | Bucksey | 123/51 R |

FOREIGN PATENT DOCUMENTS

| | | | | |
|---|---|---|---|---|
| GB | 476 386 | A | 12/1937 | |
| GB | 520 243 | A | 4/1940 | |
| GB | 570 292 | A | 6/1945 | |
| GB | WO 2008149061 | A2 * | 12/2008 | F01B 1/08 |
| WO | 03/021095 | A1 | 3/2003 | |
| WO | 2008/149061 | A2 | 12/2008 | |
| WO | 2010/096187 | A2 | 8/2010 | |

* cited by examiner

Fig. 7(a) & (m)

INTERNAL COMBUSTION ENGINES

CROSS-REFERENCE TO RELATED APPLICATIONS

This application claims priority to International Application No. PCT/GB2012/051161, filed on May 24, 2012, which claims priority to Great Britain Patent Application No. 1108766.5, filed May 24, 2011, each of which is incorporated by reference in its entirety.

FIELD OF THE INVENTION

This invention relates to internal combustion engines. More particularly it relates to internal combustion engines with an opposed piston configuration.

BACKGROUND

WO2008/149061 (Cox Powertrain) describes a 2-cylinder 2-stroke direct injection internal combustion engine. The two cylinders are horizontally opposed and in each cylinder there are opposed, reciprocating pistons that form a combustion chamber between them. The pistons drive a central crankshaft between the two cylinders. The inner piston (i.e. the piston closer to the crankshaft) in each cylinder drives the crankshaft through a pair of parallel scotch yoke mechanisms. The outer piston in each cylinder drives the crankshaft through a third scotch yoke, nested between the two scotch yoke mechanisms of the inner piston, via a drive rod that passes through the centre of the inner piston. The drive rod has a hollow tubular form and fuel is injected into the combustion chamber by a fuel injector housed within the drive rod. The wall of the drive rod has a series of circumferentially spaced apertures through which the fuel is projected laterally outwardly into the combustion chamber.

SUMMARY

The present invention is generally concerned with opposed piston internal combustion engines having a fuel injector disposed in each cylinder to inject fuel directly into a combustion chamber formed between the two opposed, reciprocating pistons in the cylinder. The present invention is a development of the configuration of the engine described in WO2008/149061 and seeks to offer embodiments that retain the benefits of that earlier engine, namely a very compact and efficient engine with a high ratio of power output to weight, whilst offering yet further benefits.

In a first aspect, the present invention provides an internal combustion engine comprising at least one cylinder, a pair of opposed, reciprocating pistons within the cylinder forming a combustion chamber therebetween, and at least one fuel injector disposed at least partly within the cylinder, the fuel injector having a nozzle that is positioned within the combustion chamber and through which the fuel is expelled into the combustion chamber, wherein the nozzle is exposed directly within the combustion chamber.

By exposing the nozzle of the injector directly to the combustion chamber (i.e. physically locating the nozzle within the combustion chamber) at the point in time of injection, as opposed to the prior art arrangement discussed above in which the injector is housed within the central drive rod, the need to inject fuel through apertures in a wall is avoided. This leads to a simpler construction, improved fuel injection, air motion and combustion characteristics, and makes it possible to use more conventional injectors.

Especially in cases where only a single injector is employed, the injector is preferably at or close to the central axis of the cylinder/piston. The injector nozzle will typically be at one end of the injector (the end that projects into the cylinder).

The concepts of the invention are applicable to compression ignition (CI & HCCI) engines and also spark ignition (SI) and spark assisted ignition engines. In For a CI embodiment, the fuel will normally be injected into the combustion chamber at or close to the point in the engine cycle where the two pistons are at their closest and the combustion chamber volume is at its smallest. The nozzle of the injector will be positioned to be located within the combustion chamber at this point in the cycle. For HCCI and SI variants, injection is likely to be much earlier in the cycle and possibly as early as intake port opening.

The nozzle of the fuel injector preferably protrudes outwardly from an end face of a housing of the injector in the direction of the cylinder axis. The nozzle may have a series of apertures around its periphery from which the fuel is expelled generally radially into the combustion chamber. Preferably there is a valve (e.g. a needle valve) in the nozzle that is operable to control a pressurised supply of fuel to the apertures. The supply of fuel can be controlled in a conventional manner.

In some embodiments, the fuel injector is fixed at one end of the cylinder, typically to a fixed, structural component, and projects into the cylinder from that end, along or parallel to the central axis of the cylinder, to locate the injector nozzle in a fixed position that is within the combustion chamber throughout the engine cycle. In this case, the injector extends through the piston closest to the end of the cylinder from which the injector projects and this piston is configured to reciprocate along a housing of the injector.

In an alternative arrangement, the fuel injector moves with one of the pistons. It may be fixed to the piston to move with it through the whole stroke of the piston or, alternatively, may move with the piston for only part of its stroke.

Typically, the motion of the pistons will drive a crankshaft positioned at one end of the cylinder, the piston closest to the crankshaft end of the cylinder being designated the "inner piston" and the piston furthest from the crankshaft being designated the "outer piston". The or each fuel injector may be associated with either the outer piston or the inner piston.

Especially in the case where the injector is fixed and the associated (e.g. outer) piston reciprocates along the injector housing, the injector is preferably cooled. Cooling can be provided, for example, by a supply of a cooling fluid (e.g. engine oil, engine cooling fluid, raw water cooling such as sea water, or fuel) to the interior of the injector housing.

In the case where one of the pistons reciprocates on the injector housing, the outer surface of the injector housing preferably provides a running surface along which the piston can slide. A sealing system, for example one or more sealing rings, is provided between the piston and the running surface of the injector housing to restrict the escape of combustion gases and the ingress of lubricating oil to the combustion chamber.

The injector may be fixed to an outer part of the engine structure by any suitable coupling. In some cases it may be desirable to use a coupling that allows the injector to self-align itself parallel to the centreline of the cylinder and to accommodate tolerances and thermal distortion of the piston it is associated with. For example, an Oldham coupling may be used (this type of coupling allows the injector to move in a plane perpendicular to its axis, to allow the desired alignment, whilst preventing movement along its axis).

In the case where the pistons drive a crankshaft, any suitable drive linkage may be used to translate the opposed reciprocating motion of the pistons into a rotary motion of the crankshaft. In preferred embodiments, however, scotch yoke mechanisms are used. Where scotch yoke mechanisms are used, as minimum it would be necessary to have at least one scotch yoke through which the inner piston (i.e. the piston closest to the crankshaft) drives the crankshaft and at least one scotch yoke through which the outer piston drives the crankshaft. However, to avoid undesirable unbalanced forces on the outer piston, whilst avoiding the need for a central drive rod through the cylinder, it is more preferable for the outer piston to drive the crankshaft through a pair of scotch yokes, one to either side of the cylinder connected to the outer piston by respective connection members on opposite sides of the cylinder. The connection members may, for example be rods or sleeve portions within the cylinder, at or close to the periphery of the cylinder. More preferably, the connection members are external to the cylinder. They may comprise, for example, one or more drive rods.

In a second aspect, the present invention provides an internal combustion engine comprising at least one cylinder, a pair of opposed, reciprocating pistons within the cylinder forming a combustion chamber therebetween, and at least one fuel injector disposed on or parallel with the central axis of the cylinder configured to inject fuel into the combustion chamber, wherein the pistons drive a crankshaft disposed at one end of the cylinder via respective drive linkages, the drive linkage for the piston furthest from the crankshaft (the 'outer' piston) being external to the cylinder.

By providing the linkage for the outer piston external to the cylinder, the need for any drive rods passing through the inner cylinder is avoided. The absence of a drive rod or rods passing through the combustion chamber also allows for a more straightforward, conventional combustion chamber design, simpler cooling of the inner piston, elimination of a blowby path to the crankcase and elimination of heat losses to the drive rod. The use of an external linkage also means that an injector can be located centrally with respect to the piston (or close to the centre of the piston) without obstruction.

As with embodiments of the first aspect above, any suitable drive linkage may be used to translate the opposed reciprocating motion of the pistons into a rotary motion of the crankshaft but scotch yoke mechanisms are preferred. For instance, the outer piston may drive the crankshaft through a pair of scotch yokes, one to either side of the cylinder, connected to the outer piston by the external drive linkage. The external drive linkage may comprise connection members to either side of the cylinder, for example one or more drive rods.

Whilst a single cylinder configuration is possible preferred engines in accordance with embodiments of the first and/or second aspects of the invention comprise multiple cylinders, for example two cylinders, four cylinders, six cylinders, eight cylinders or more.

Where multiple cylinders are used, various configurations are possible that may offer different benefits in terms of balance of forces, overall shape and size of the engine, etc. Exemplary configurations include (but are not limited to) coaxial opposed pairs of cylinders (e.g. 'flat two', 'flat four', etc), 'straight' configurations with all of the cylinders side-by-side, 'U' configurations with two straight banks of cylinders side-by-side (e.g. 'square 4'), 'V' configurations and 'W' configurations (i.e. two adjacent banks of 'V' configured cylinders) and radial configurations. Depending on the configuration, the multiple cylinders may drive a single crankshaft or a plurality of crankshafts. Typically 'flat', 'straight', 'V' and radial configurations will have a single crankshaft, whereas 'U' and 'W' configurations will have two crankshafts, one for each bank of cylinders. In some embodiments of the invention it is possible to use two engine units (each with one or more cylinders) with contra-rotating crankshafts that drive a shared output shaft through a bevel gearbox. This arrangement has the advantage that torque recoil effects are balanced.

BRIEF DESCRIPTION OF THE DRAWINGS

An embodiment of the invention is now described by way of example, with reference to the accompanying drawings in which.

DETAILED DESCRIPTION

Figure 4:
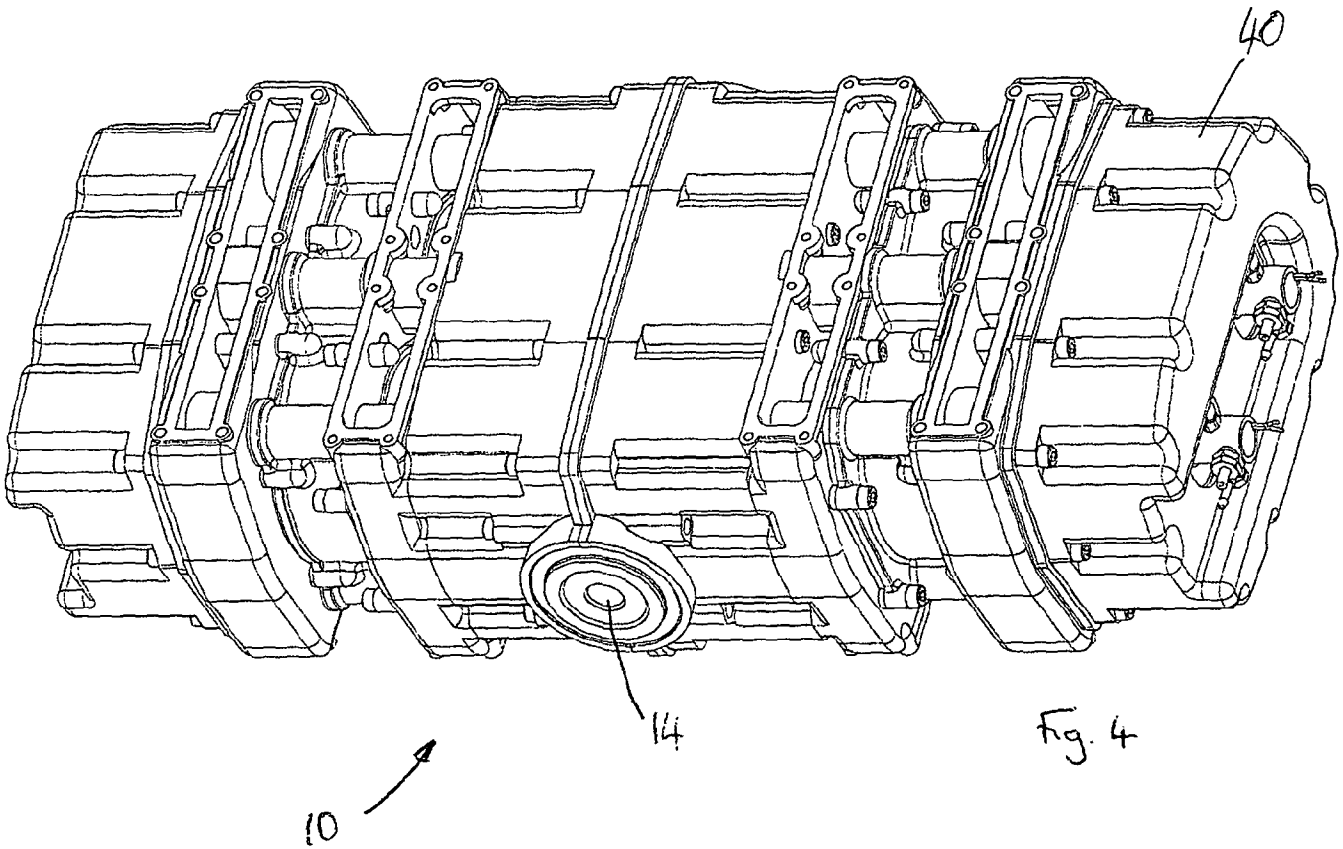
FIG. 4 is an isometric view of the engine of FIG. 1.

The embodiment used here to exemplify the invention is a 2-stroke, direct injection, four cylinder engine. The engine is configured with two horizontally opposed pairs of cylinders. One pair of cylinders is arranged alongside the other to give a 'flat four' configuration. As probably best seen in FIG. 4, this configuration provides the engine with a low-profile overall envelope that will be advantageous for some applications, for example for use as an outboard marine engine. Engines in accordance with embodiments of the invention can also be used as propulsion or power generation units for other marine applications, as well as for land vehicles and aircraft.

Figure 2:
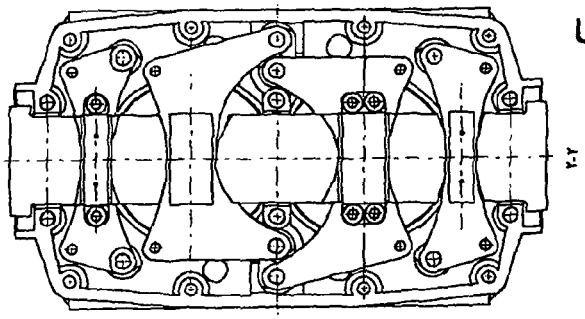
FIG. 2 is a cross-section of the engine of FIG. 1 along line z-z in FIG. 1.
Figure 1:
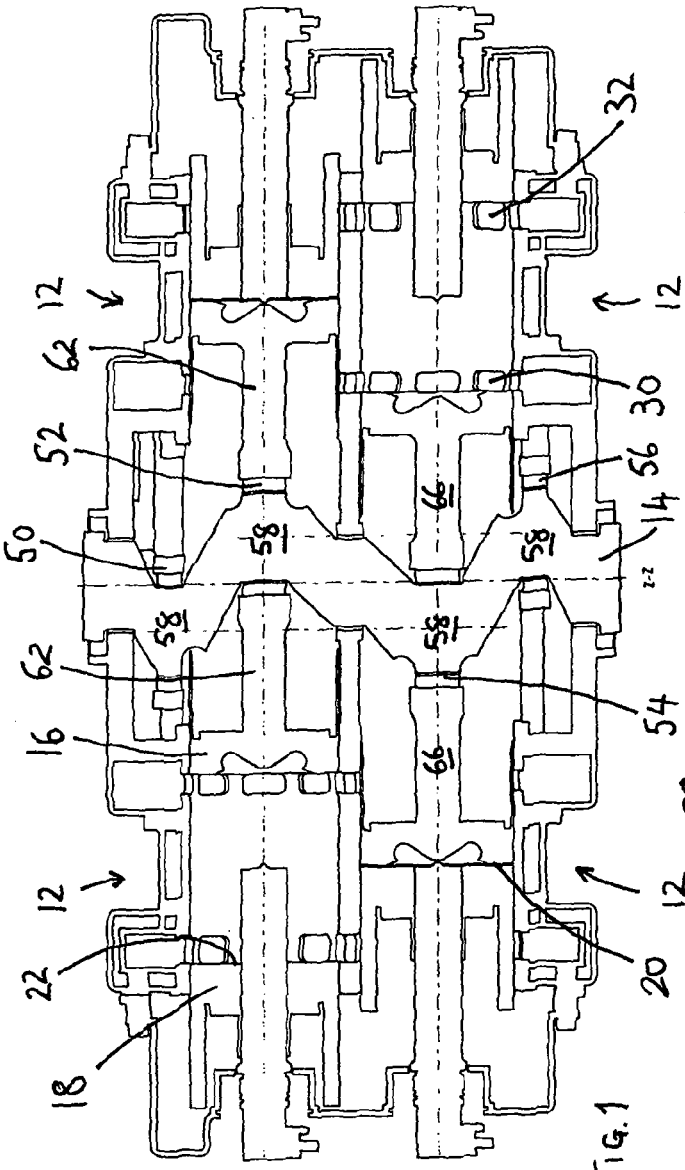
FIG. 1 is a cross-section through a flat four engine configuration according to an embodiment of the present invention.
Figure 3:
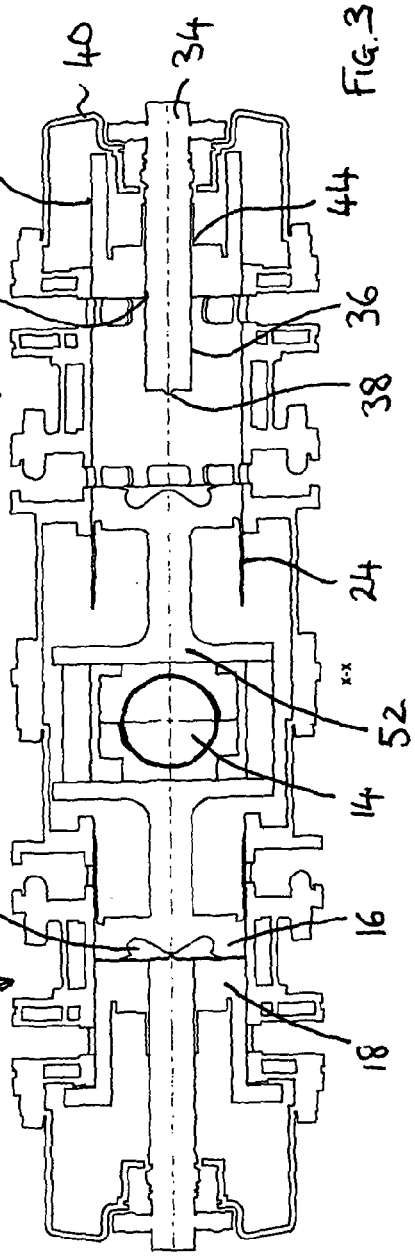
FIG. 3 is a cross-section of the engine of FIG. 1 along the centre line of the lowermost opposed pair of cylinders as shown in FIG. 1.

In more detail, looking initially at FIGS. 1 to 3, the engine 10 comprises four cylinders 12 arranged about a central crankshaft 14, mounted for rotation about axis z-z (see FIG. 1). The two cylinders, one either side of the crankshaft, to the bottom of FIG. 1 are one opposed pair of cylinders and the two other cylinders, towards the top of FIG. 1 are the other pair of opposed cylinders.

Within each cylinder there are two pistons, an inner piston 16 and an outer piston 18. The two pistons in each cylinder are opposed to one another and reciprocate in opposite directions, in this example 180 degrees out of phase.

Each piston has a crown 20, 22, the crowns of the two pistons facing one another, and a skirt 24, 26 depending from the crown. In this example, the crown 26 of the outer piston is substantially flat whereas the crown 24 of the inner piston has an annular depression with a generally tear-drop shaped cross-section. At top dead centre, when the piston crowns are closest to one another (and very nearly touching), the opposed crowns 24, 26 define a toroidal combustion chamber 28 into which the fuel is injected.

As explained in more detail further below, when the pistons are at a position in their cycle where they are spaced furthest from one another to define a maximum contained volume within the cylinder ("bottom dead centre"), as seen for the top left and bottom right cylinders in FIG. 1, the piston crowns are withdrawn sufficiently far to uncover intake ports 30 and exhaust ports 32, towards the inner and outer ends of the cylinder respectively. As the pistons 16, 18 move towards one another in the compression stroke of the cycle, the piston skirts cover and close the ports, the skirt 24 of the inner piston 16 closing the intake port 30 and the skirt 26 of the outer piston 18 closing the exhaust port 32. As best seen in FIGS. 1 and 2, the exhaust ports 32 have a greater axial extent (i.e. dimension in the direction of the longitudinal axis of the cylinder) than the intake ports so that the exhaust ports open sooner than and stay open longer than the intake ports, to aid scavenging of the cylinder.

Associated with each cylinder 12 is a fuel injector 34. The fuel injector 34 has a cylindrical housing 36 with an injector nozzle 38 at one end. Fuel is supplied under pressure to the nozzle, through the injector housing, in a conventional manner. The nozzle 38 projects from an end face of the injector housing 36, and has a series of apertures equally spaced around its periphery through which fuel is injected in a generally radial direction. The nozzle is opened and closed by a needle valve (not shown). When the needle valve is open fuel is injected under pressure through the apertures. The opening and closing of the needle valve can be controlled in a conventional manner. In use, the injector housing may be cooled by a supply of a coolant fluid, which may be the fuel itself or an engine coolant for example (although this may not be required in some cases).

The fuel injector 34 is mounted along the central axis of the cylinder 12. In this example, an outer end of the injector 34 is fixed to a component 40 at the outer end of the cylinder (i.e. the end of the cylinder opposite the crankshaft 14). The injector 34 extends through a central opening 42 in the outer piston crown 22 to locate the inner end of the injector, from which the nozzle 38 projects, centrally in the cylinder 12. More specifically, as seen in the bottom left and top right cylinders in FIG. 1 and the left hand cylinder in FIG. 2, when the pistons 16, 18 are at top dead centre, the nozzle 38 of the fuel injector 34 is directly within the toroidal combustion chamber 28 and fuel can be injected laterally from the nozzle 38 into the combustion chamber 28.

In the central injector arrangement described here the injector 34 is fixed in position and, during operation of the engine 10, the outer piston 18 travels along the outside of the injector housing 36. Appropriate seals 44 are provided around the periphery of the opening 42 in the outer piston crown 22 to maintain a seal between the piston crown 22 and the injector housing 36 as the piston 18 reciprocates back and forth along the injector housing 36, to avoid or at least minimise leakage of pressurised gases from within the cylinder and to prevent ingress of oil to the combustion chamber.

The fuel injectors 34 themselves can be of conventional construction, save that the outer surface of the injector housing is configured to allow sliding contact with the piston 18. Typically the fuel spray will take the form of a plurality of radial jets spaced around a nozzle of the injector and controlled by a single valve arrangement (e.g. a needle valve arrangement comprising a needle and seat that the needle engages to close the valve). The fuel injector may, for example, be a conventional injector housed in a sleeve that provides the outer housing along which the piston slides. In this arrangement, the nozzle of the conventional injector would protrude from one end of the sleeve. The injector may be surrounded by a coolant within the sleeve, although this may not be required in some embodiments. Alternatively, a bespoke injector may be used, having a body that provides a running surface on its outside, and optionally cooling within, although in this case the internal components may still be conventional.

Figure 5:
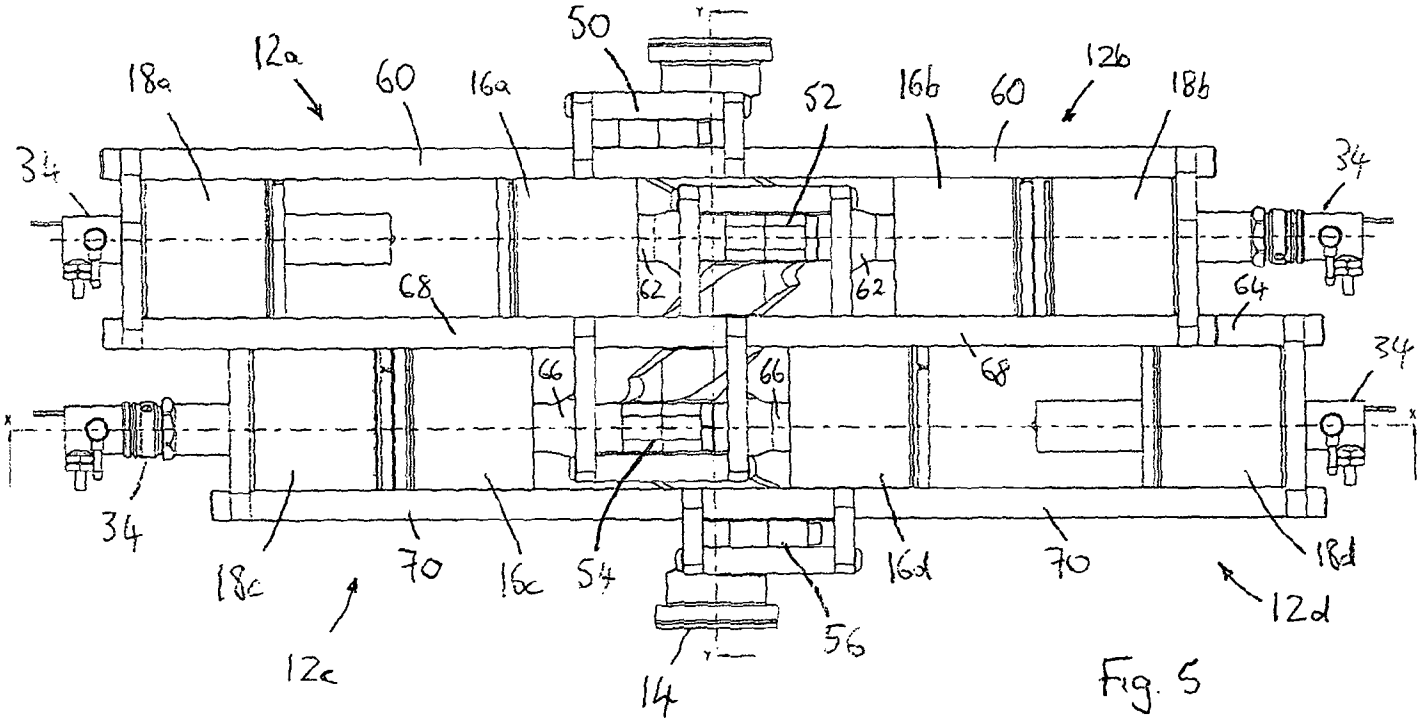
FIG. 5 is a simplified plan view of key components (in an assembled form) of the engine of FIG. 1, including the crankshaft, scotch yokes, pistons, drive rods and fuel injectors.
Figure 6:
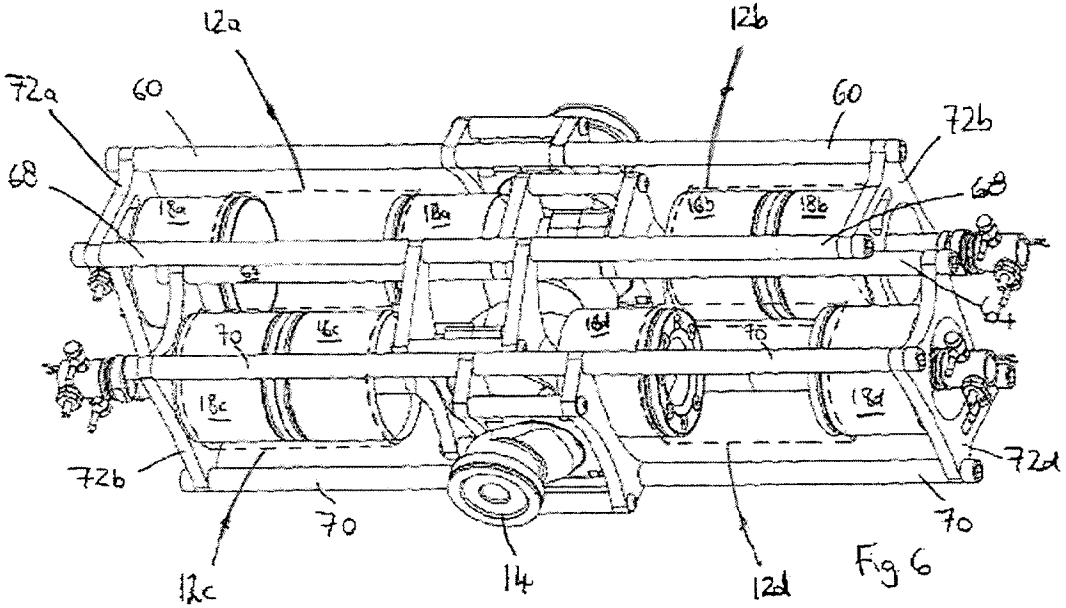
FIG. 6 is a simplified isometric view of the key components shown in FIG. 5.

In this example, the pistons 16, 18 drive the crankshaft 14 through four scotch yoke arrangements 50, 52, 54, 56, mounted on respective eccentrics 58 on the crankshaft 14. The connections between the pistons 16, 18 and the scotch yokes 50, 52, 54, 56, especially those for the outer pistons 18, are best seen in FIGS. 5 and 6. In this example, the scotch yokes are shared by multiple pistons, as explained in more detail below, to minimise the number of scotch yokes that and hence to minimise a required length of the crankshaft providing a more compact design.

The directions/relative positions ("upper", "lower", "left", "right", etc) used below and elsewhere herein refer to the relative positions of components as drawn and should not be taken to imply any particular orientation of the engine, or positions on the engine components in space.

Looking at FIG. 5, the four scotch yokes 50, 52, 54, 56 can be seen connected to the crankshaft 14 extending vertically through the middle of the figure.

A first scotch yoke 50 (at the top of FIG. 5) is connected adjacent one end of the crankshaft 14. Drive rods 60 connect this yoke 50 to the outer pistons 18*a*, 18*b* of the two upper cylinders 12*a*, 12*b* (as seen in FIG. 5). As best seen in FIG. 6, there are two drive rods 60 per outer piston 18*a*, 18*b*, secured to adjacent corners (the uppermost corners in FIG. 1, towards the top end of the crankshaft) of a connection plate 72*a*, 72*b* that is itself secured to the piston 18*a*, 18*b*. The connection plate 72*a*, 72*b* extends beyond the outer circumference of the cylinder 12 so that the drive rods 60 extend from the corners of the plate 72*a*, 72*b* along the outside of the cylinders (i.e. externally).

A second scotch yoke 52 is positioned between the two upper cylinders 12*a*, 12*b* and is connected to the inner pistons 16*a*, 16*b* of these two cylinders by respective drive rods 62 (most clearly seen in FIG. 1). Drive rods 62 extend from the centres of the inner pistons 16*a*, 16*b* to their connections with the scotch yoke 52. Advantageously, the second scotch yoke 52 is also connected to the lower pair of outer pistons 18*c*, 18*d* by drive rods 64. Similarly to drive rods 60 discussed above, there are two of these rods 64 per piston that extend from adjacent corners of respective connection plates 72*c*, 72*d* (in this case the two corners that are closest to the mid-point of the crankshaft) that are secured to the outer ends of the outer pistons 18*c*, 18*d*.

A third scotch yoke 54 is positioned between the two lower cylinders 12*c*, 12*d* and is connected to the inner pistons 16*a*, 16*b* of these two cylinders by respective drive rods 66 (again, most clearly seen in FIG. 1). Drive rods 66 extend from the centres of the inner pistons 16*c*, 16*d* to their connections with the scotch yoke 54. Similarly to the second scotch yoke 52, this third scotch yoke is additionally connected to the upper pair of outer pistons 18*a*, 18*b* by drive rods 68. There are two of these rods 68 per piston and they extend from the other two adjacent corners of connection plates 72*a*, 72*b* (opposite the corners from which the drive rods 60 extend, i.e. the two corners that are closest to the mid-point of the crankshaft).

The fourth scotch yoke 56 is shown at the lower end of the crankshaft 14 in FIG. 5. This yoke 56 is connected to the lower pair of outer pistons 18*c*, 18*d* by another pair of drive rods 70 for each piston 18*c*, 18*d*. These rods are connected to respective lower corners (i.e. the corners opposite those to which the drive rods 64 are connected) of the connection plates 72*c*, 72*d* fixed to the lower pair of outer pistons 18*c*, 18*d*.

The connection plates 72 are shaped so that the drive rods connected to their corners closest to the mid-point of the crankshaft lie parallel and alongside one another without interfering with one another during motion of the pistons.

Thus, each of the upper outer pistons 18*a*, 18*d* is connected to the first scotch yoke 50 by a first pair of drive rods 60 and to the third scotch yoke 54 by a second pair of drive rods 68. Each of the lower outer pistons 18*c*, 18*d* are connected to the fourth scotch yoke 56 by a first pair of drive rods 70 and to the second scotch yoke 52 by a second pair of drive rods 64. The upper inner pistons 16*a*, 16*b* are connected to the second scotch yoke 52 by respective central drive rods 62 and the lower inner pistons 16*c*, 16*d* are connected to the third scotch yoke 54 by respective central drive rods 66.

Put another way, the first scotch yoke 50 is driven by the upper outer pistons 18*a*, 18*b*, the second scotch yoke 52 is driven by the upper inner pistons 16*a*, 16*b* and the lower outer pistons 18*c*, 18*d*, the third scotch yoke 54 is driven by the lower inner pistons 16*c*, 16*d* and the upper outer pistons 18*a*, 18*b* and the fourth scotch yoke 56 is driven by the lower outer pistons 18*c*, 18*d*.

As noted above, this sharing of scotch yokes between inner and outer pistons reduces the number of scotch yokes that would otherwise be required, minimising the required length of the crankshaft.

The cross-linking, via the scotch yokes, of inner pistons in one opposed pair of cylinders with outer pistons in the other opposed pair of cylinders also helps to stabilise the pistons within the cylinders, resisting unwanted rotation of the pistons about axes perpendicular to the central axis of the cylinder. This arrangement in also serves to locate the yoke sliders, avoiding a requirement for other features (such as tracks or cylindrical running surfaces) to locate them.

Operation of the Engine

Figure 7:
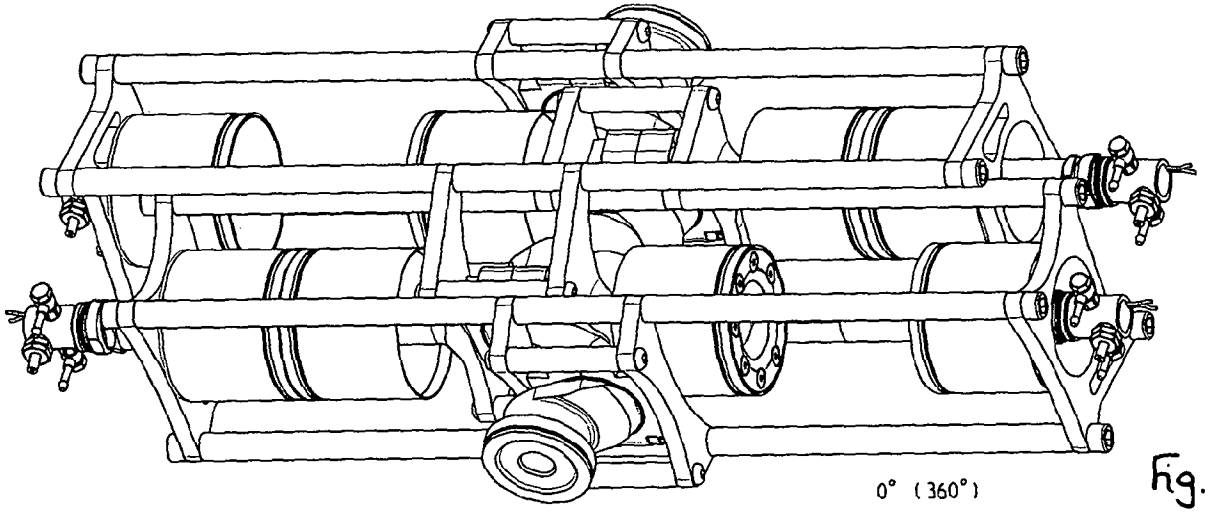
FIGS. 7(*a*) to 7(*m*) show snapshots of the engine of FIG. 1 through one complete revolution of the crankshaft at 0°, 30°, 60°, 90°, 120°, 150°, 180°, 210°, 240°, 272°, 300°, 330°, 360° respectively, starting from the point in the cycle of minimum combustion chamber volume (referred to in the following for convenience as lop dead centre' or 'TDC'—this terminology (TDC) is used because the skilled person will recognise that is the analogous point in the operating cycle for a more conventionally disposed engine) of the cylinder seen in the bottom left of the figure.
Figure 7:
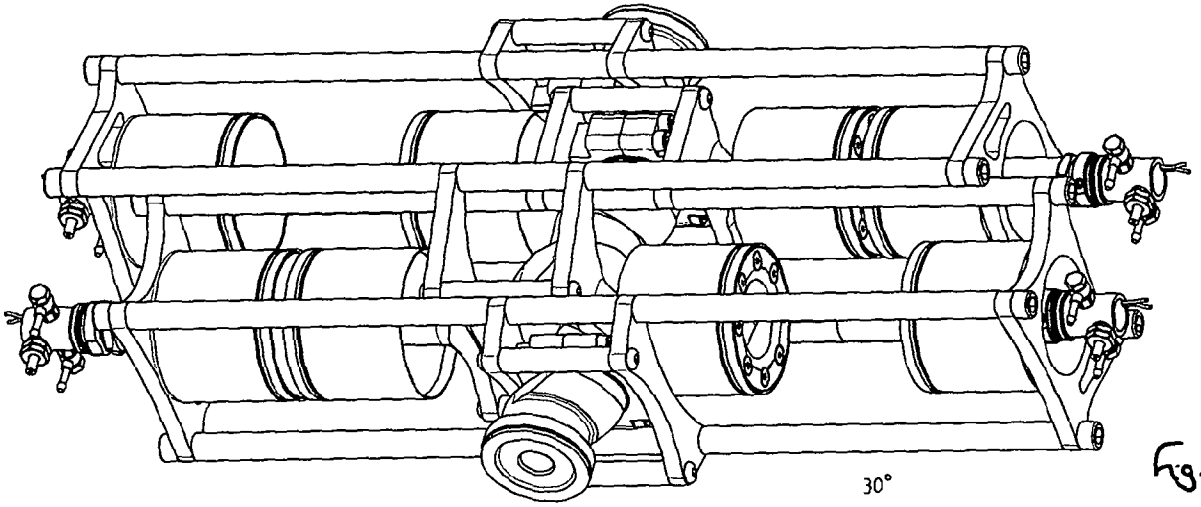
Figure 7C:
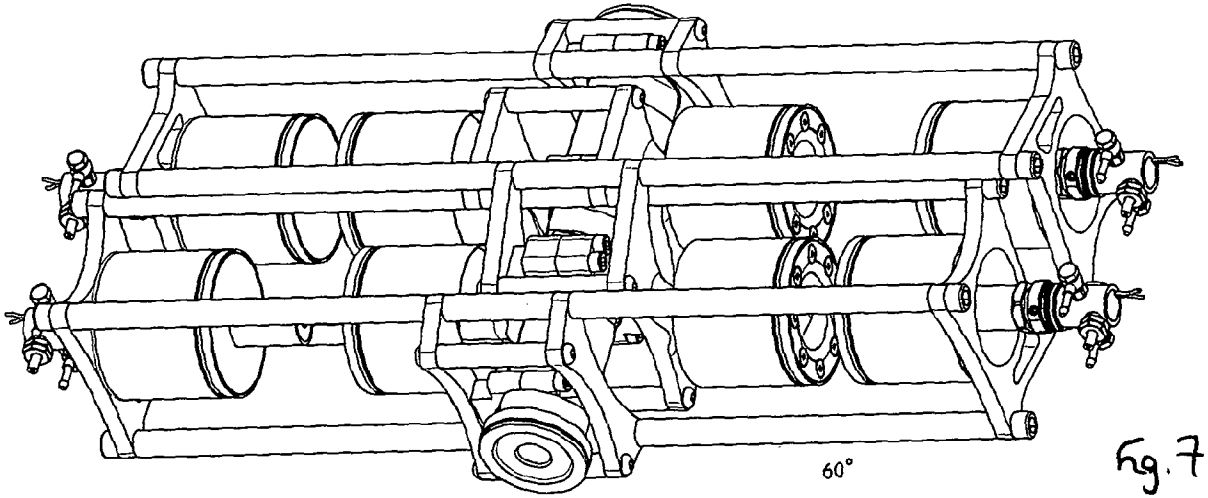
Figure 7D:
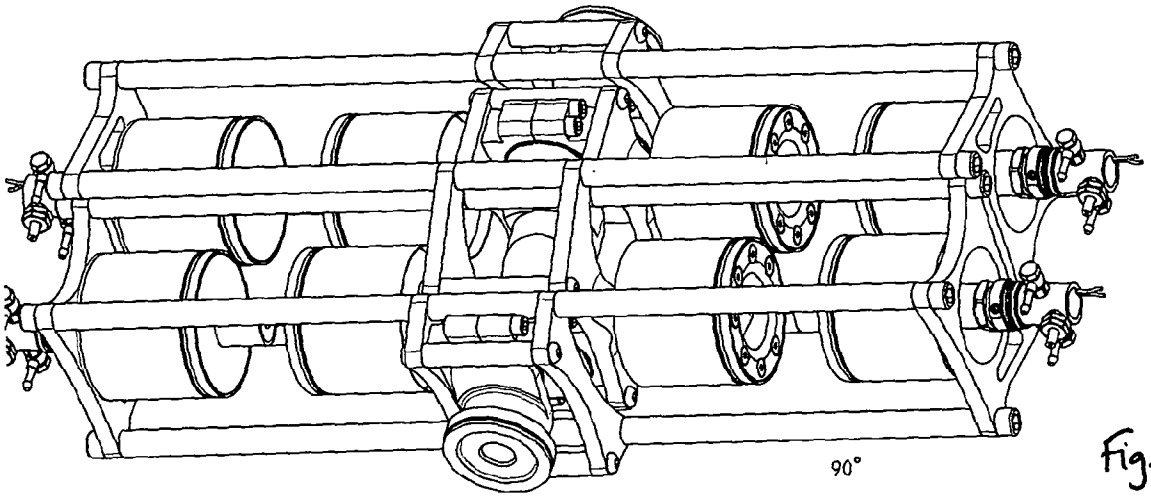
Figure 7E:
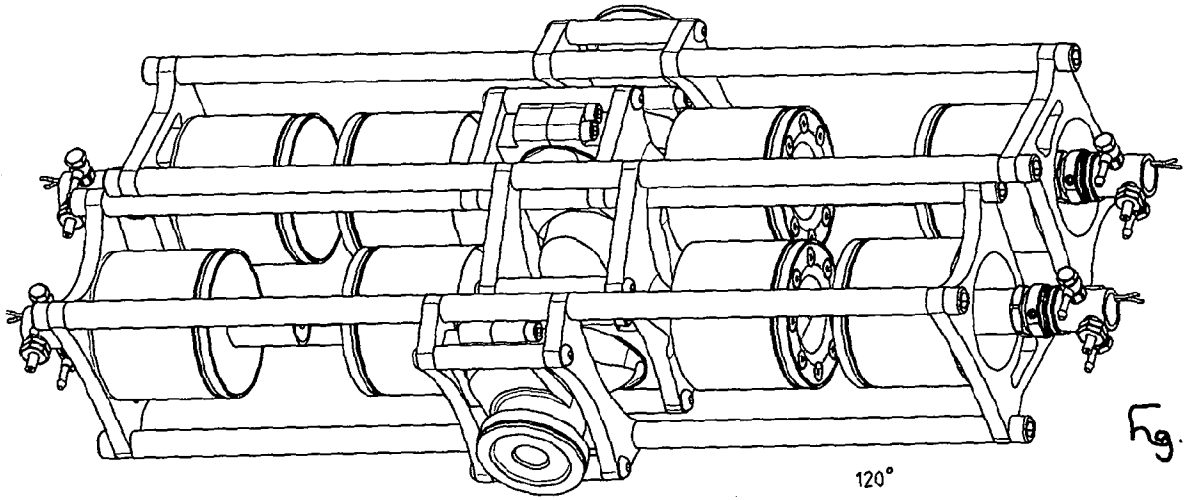
Figure 7F:
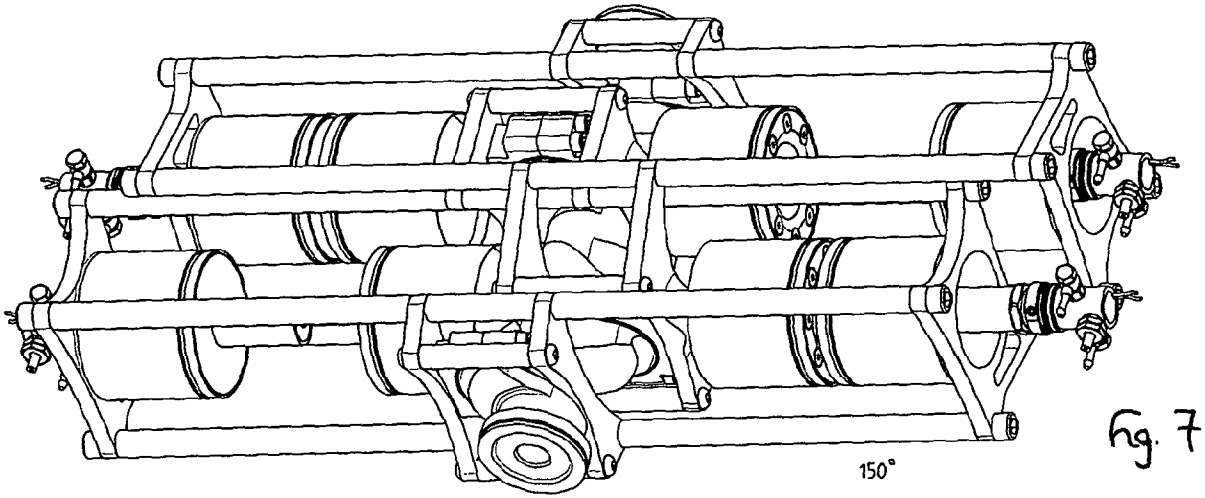
Figure 7G:
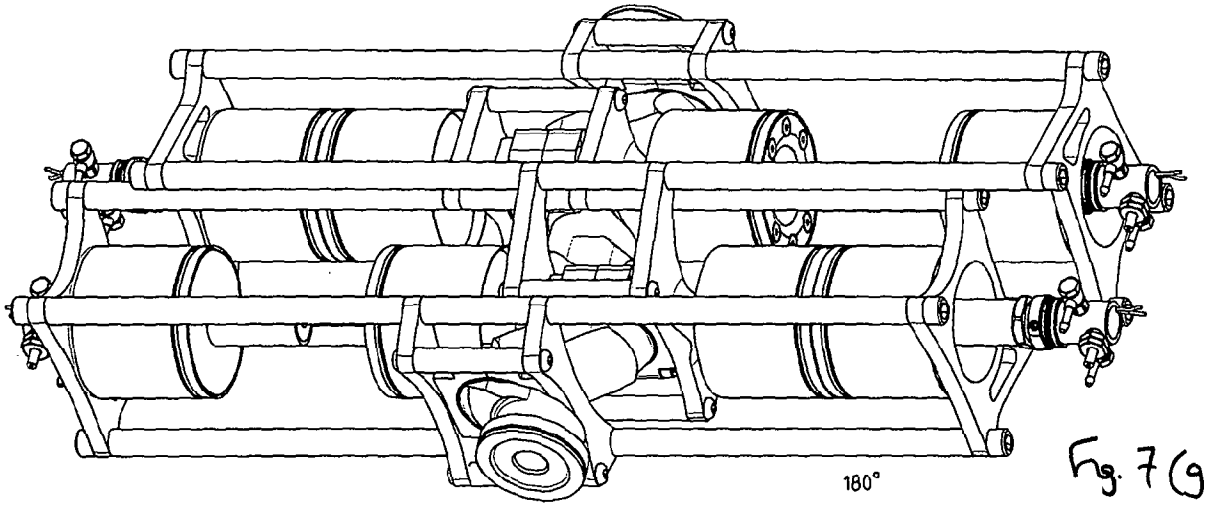
Figure 7H:
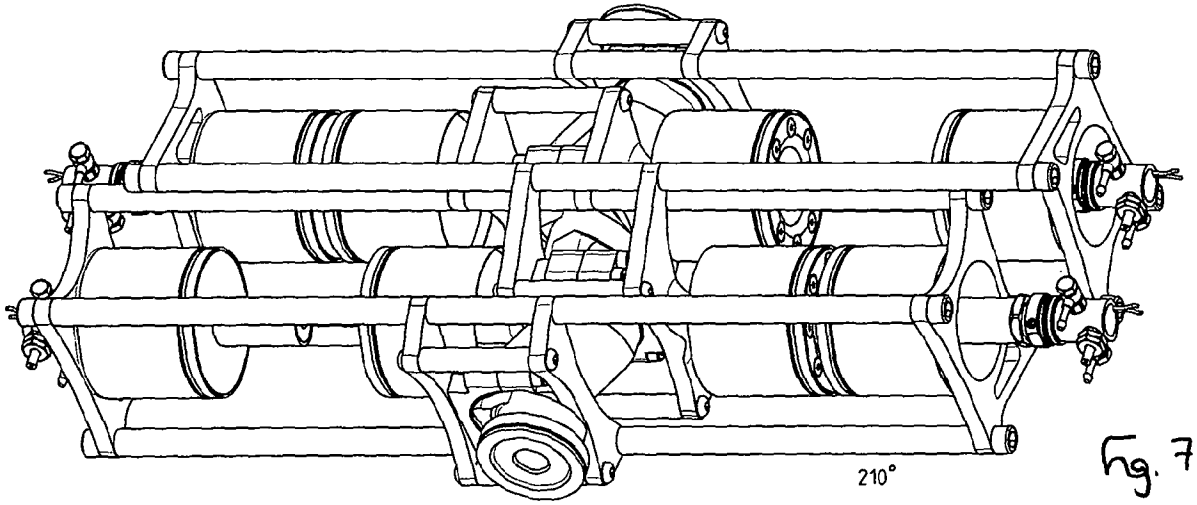
Figure 7I:
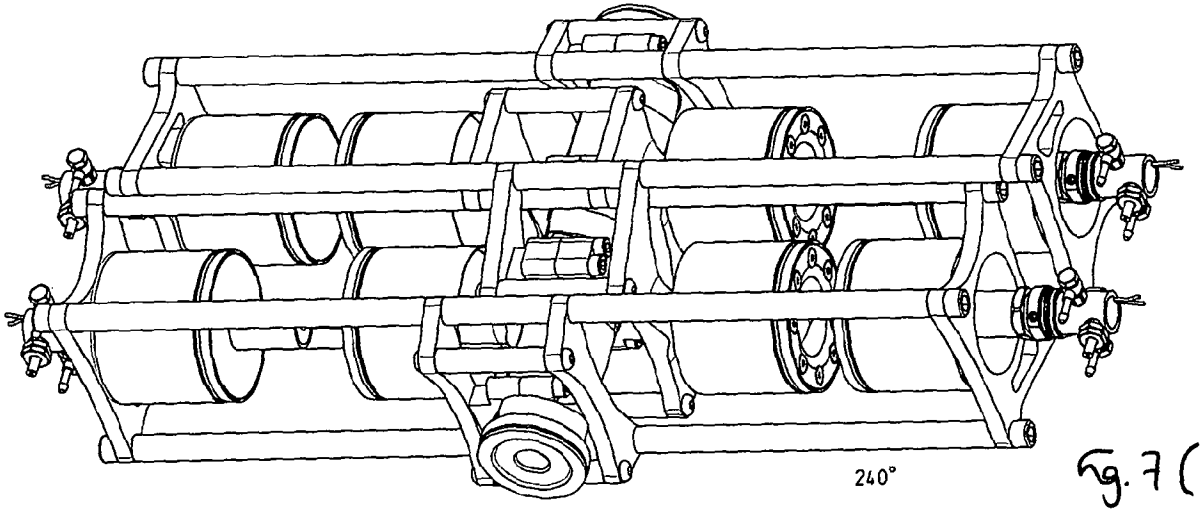
Figure 7J:
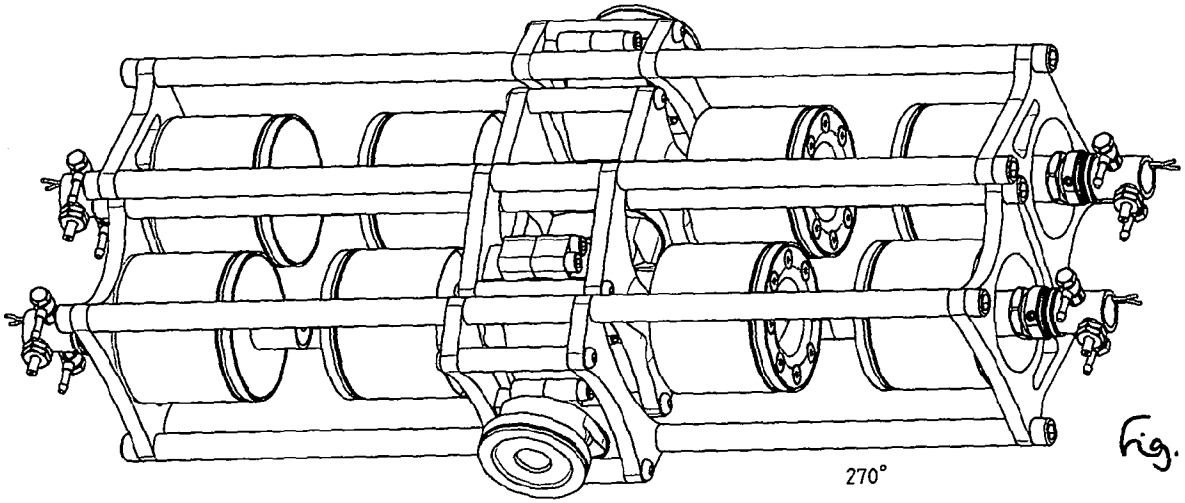
Figure 7K:
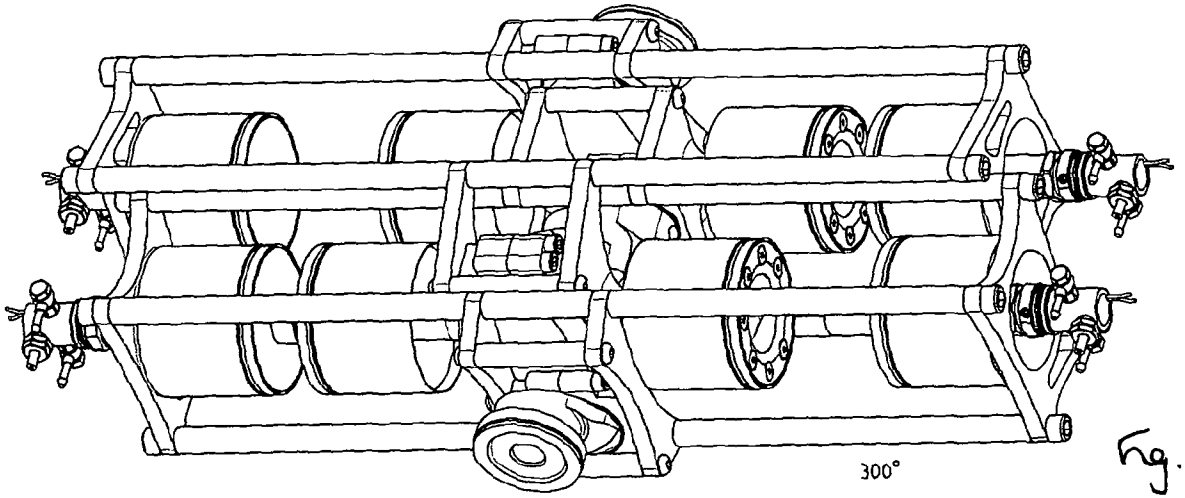
Figure 7L:
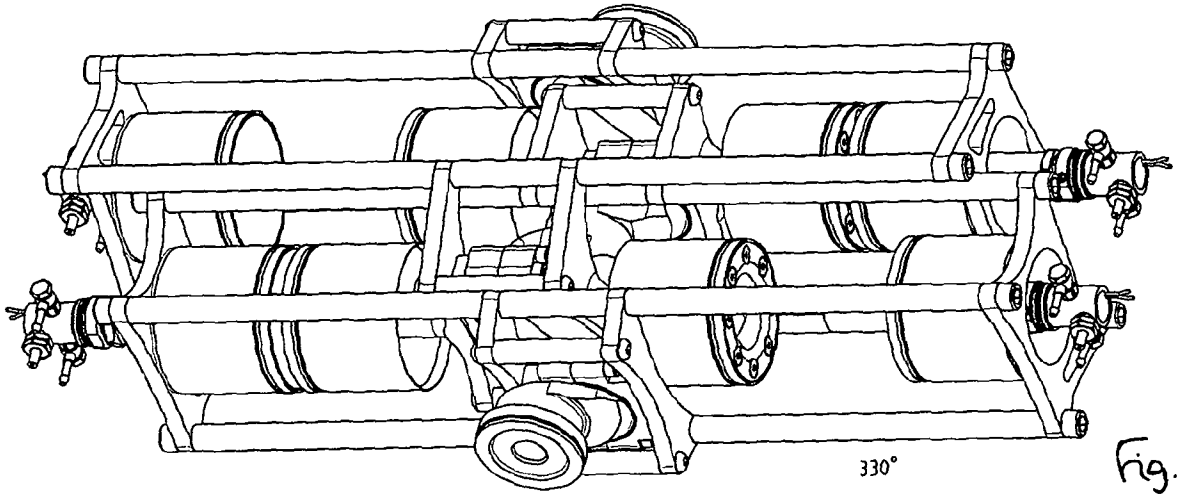

FIG. 7 illustrates the operation of the engine over one complete crankshaft rotation. Specifically, FIGS. 7(*a*) to 7(*m*) illustrate the piston positions at 30° increments.

FIG. 7(*a*) at 0° ADC shows the engine at a crankshaft position of 0° (arbitrarily defined as TDC in the bottom left cylinder 12*c* of FIG. 5). At this position, the bottom left outer piston 18*c* and the bottom left inner piston 16*c* are at their point of closest approach. At approximately this angle of crankshaft rotation, in the exemplified direct-injection engine, a fuel charge would be injected into the bottom left cylinder and combustion would begin. At this point, the exhaust and intake ports 32, 30 of the bottom left cylinder are completely closed by outer and inner pistons respectively.

In FIG. 7(*b*) at 30° ADC, the inner and outer pistons of the bottom left cylinder are moving apart at the beginning of the power stroke.

In FIG. 7(*c*) at 60° ADC, the bottom left cylinder continues its power stroke, with the two pistons equal but opposite velocities.

In FIG. 7(*d*) at 90° ADC, the bottom left cylinder continues its power stroke.

In FIG. 7(*e*) at 120° ADC, the outer piston of the bottom left cylinder has opened exhaust ports 32, while the intake ports remain closed. In this "blowdown" condition, some of the kinetic energy of the expanding gases from the combustion chamber can be recovered externally if desired by a turbocharger ("pulse" turbocharging) e.g. for compressing the next.

In FIG. 7(*f*) at 150° ADC, the inner piston of the bottom left cylinder has opened the intake ports 30 and the cylinder is being uniflow scavenged.

In FIG. 7(*g*) at 180° ADC, the inner and outer pistons of the bottom left cylinder are causing both intake and exhaust ports 30, 32 to remain open and uniflow scavenging continues. The pistons are at bottom dead centre.

In FIG. 7(*h*) at 210° ADC, in the bottom left cylinder, both sets of ports 30, 32 remain open and uniflow scavenging continue.

In FIG. 7(*i*) at 240° ADC, in the bottom left cylinder, the inner piston has closed the intake ports 30, while the exhaust ports 32 remain partially open. In other embodiments the exhaust port may open after and/or close before the inlet port opens/closes. It may also be desirable in some applications for the port timing to be asymmetric, for example by using a sleeve valve to control the opening and closing of the ports.

In FIG. 7(*j*) at 270° ADC, in the bottom left cylinder, the outer piston has closed the exhaust ports 32 and the two pistons are moving towards each other, compressing the air between them.

In FIG. 7(*k*) at 300° ADC, in the bottom left cylinder, the pistons continue the compression stroke.

In FIG. 7(*l*) at 330° ADC, the bottom left cylinder is nearing the end of the compression stroke and the "squish" phase is beginning. This is where the outer, annular, opposite faces of the inner and outer pistons begin to expel air from between them.

In FIG. 7(*m*) at 360° ADC, the position is the same as in FIG. 3(*a*). The bottom left cylinder has reached the TDC position, where the pistons are at their position of closest approach. The "squish" phase continues, causing an intensifying "smoke ring" effect to be superimposed on the already existing cylinder axis swirl caused by partially tangential intake ports. These compound gas motions will be at their most intense at TDC when the combustion chamber most nearly resembles a toroid and is of minimum volume. At this point, multiple radial fuel sprays emanate from the central fuel injector, reaching almost all of the available air and causing very efficient combustion. Injection need not commence exactly at minimum volume and in some embodiments injection timing may change as a function of speed and/or load.

The specific angles and timings depend on the crankshaft geometries and port sizes and locations; the above description is intended solely to illustrate the concepts of the invention.

The skilled person will appreciate that various modification to the specifically described embodiment are possible without departing from the invention. The fuel injector might project from the inner end of the cylinder, with the inner piston sliding on the injector. In this case the combustion bowl would likely be formed in the outer piston. The skilled person will also appreciate that embodiments of the invention may be 2-stroke or 4-stroke and may be compression ignition or spark ignition.

The invention claimed is:

1. An internal combustion engine comprising:

at least one cylinder;

a pair of opposed, reciprocating pistons within the cylinder forming a combustion chamber therebetween;

a crankshaft positioned at one end of the cylinder, wherein reciprocating motion of the pistons drives the crankshaft; and at least one fuel injector disposed at least partly within the cylinder, the fuel injector having a nozzle that is positioned within the combustion chamber and through which the fuel is expelled into the combustion chamber;

wherein the nozzle of the fuel injector protrudes outwardly from an end face of a housing of the injector in the direction of the cylinder axis so that the nozzle is exposed directly within the combustion chamber; and wherein the fuel injector is fixed at the end of the cylinder further from the crankshaft and projects into the cylinder from that end, along or parallel to the central axis of the cylinder, to locate the injector nozzle in a fixed position that is within the combustion chamber when the combustion chamber volume is at its minimum, the fuel injector extending through the piston furthest from the crankshaft and this piston being configured to reciprocate along the housing of the injector.

2. The internal combustion engine according to claim 1, wherein the fuel injector is disposed on or parallel to the central axis of the cylinder.

3. The internal combustion engine according to claim 1, wherein the nozzle of the fuel injector protrudes outwardly from an end face of a housing of the injector in the direction of the cylinder axis.

4. The internal combustion engine according to claim 3, wherein the nozzle has a series of apertures around its periphery from which the fuel is expelled generally radially into the combustion chamber.

5. The internal combustion engine according to claim 1, wherein the fuel injector is fixed at one end of the cylinder and projects into the cylinder from that end, along or parallel to the central axis of the cylinder, to locate the injector nozzle in a fixed position that is within the combustion chamber when the combustion chamber volume is at its minimum.

6. The internal combustion engine according to claim 5, wherein the injector extends through the piston closest to the end of the cylinder from which the injector projects and this piston is configured to reciprocate along a housing of the injector.

7. The internal combustion engine according to claim 1 wherein the injector is cooled.

8. The internal combustion engine according to claim 1, wherein the engine further comprises a crankshaft positioned at one end of the cylinder and reciprocating motion of the pistons drives the crankshaft, the fuel injector being associated with the outer piston that is furthest from the crankshaft.

9. The internal combustion engine according to claim 8, further comprising a drive linkage connecting the pistons to the crankshaft to translate the opposed reciprocating motion of the pistons into a rotary motion of the crankshaft.

10. The internal combustion engine according to claim 9, wherein the drive linkage comprises a plurality of scotch yoke mechanisms.

11. The internal combustion engine according to claim 10, comprising at least one scotch yoke through which the inner piston drives the crankshaft and at least two scotch yokes, one to each side of the cylinder, through which the outer piston drives the crankshaft.

12. The internal combustion engine according to claim 11, wherein said pair of scotch yokes are connected to the outer piston by respective connection members on opposite sides of the cylinder, wherein the connection members are external to the cylinder.

* * * * *